United States Patent [19]

Back et al.

[11] Patent Number: 5,006,715

[45] Date of Patent: Apr. 9, 1991

[54] ION EVAPORATION SOURCE FOR TIN

[75] Inventors: Peter B. Back, Canoga Park, Calif.; Mark W. Utlaut, Scappoose, Oreg.; William M. Clark, Jr., Thousand Oaks, Calif.

[73] Assignee: Hughes Aircraft Company, Los Angeles, Calif.

[21] Appl. No.: 352,440

[22] Filed: May 16, 1989

[51] Int. Cl.[5] ..... H01J 27/26

[52] U.S. Cl. ..... 250/423 R; 313/230; 313/232; 313/362.1; 315/111.81; 250/424

[58] Field of Search ..... 250/423 R; 427/376.8; 420/555, 557; 313/230, 232, 362.1; 315/111.81

[56] References Cited

U.S. PATENT DOCUMENTS 3,150,901 9/1964 Esten et al. ..... 420/555
4,318,029 3/1982 Jergenson ..... 250/423 R
4,686,414 8/1987 McKenna et al. ..... 250/423 R

OTHER PUBLICATIONS

Binary Alloy Phase Diagrams, vol. 2, 1985, p. 1165.

*Primary Examiner*—Jack I. Berman
*Attorney, Agent, or Firm*—Paul M. Coble; Wanda K. Denson-Low

[57] ABSTRACT

An ion evaporation source for tin ions is prepared by coating a source element with a wettability enhancing gallium coating, and then loading the source with tin. The tin may be the naturally occurring tin, but can be an enriched tin containing a higher concentration of $Sn^{120}$. The source produces a beam having a high fraction of $Sn^{+}$ and $Sn^{++}$ ions, and a small amount of the ionized wettability coating material. All but the desired ions are readily separated from the beam.

6 Claims, 1 Drawing Sheet

ION EVAPORATION SOURCE FOR TIN

BACKGROUND OF THE INVENTION

This invention relates to the production of ion beams, and, more particularly, to an ion evaporation source for tin ions.

Liquid metal ion sources provide high current densities of metallic ions from a source having a small virtual source size. Such high brightness and small source size are required when the ion beam is to be focused with a high resolution of, for example, less than one micrometer spot size, and utilized in applications such as fabrication of semiconductor microcircuits. The high current density and small virtual source size are achieved by emitting the ions from a substrate having a sharp point, such as the point of a needle. In one such approach, a needle is covered with a layer of liquid ion source metal, and a cusp in the liquid metal at the point of the needle is created by application of an electrostatic field. This fine cusp then becomes the emitting source for evaporation of the ions. As the ions are emitted from the source, more liquid metal must flow from a reservoir down the needle to the cusp, to replenish that evaporated.

For this type of high brightness ion source to operate properly, the ion source metal must wet the needle to ensure a smooth flow of metal from the reservoir to the cusp. If the ion source metal does not wet the needle, or wets the needle incompletely, the source metal alloy may form balls or lumps along the surface of the needle, thereby interfering with the metal flow, preventing the formation of the cusp, and increasing the apparent source size, with the result that the emitted ion beam cannot be properly focused.

The needle of the evaporation source is typically made from a metal having sufficient ductility that it can be formed into the shape of a needle, but of sufficient resistance to degradation in the liquid metal of the ion source that it will have a long life. Tungsten is a commonly used material for the needle, and is also used in the combined heater and reservoir that heats the needle and holds the liquid metal that flows to the needle tip as the source operates. Rhenium, molybdenum, and other refractory metals may also be utilized.

One of the increasingly important ions for which an evaporation source is needed is tin. Beams of tin ions having large numbers of ions per unit area cross section of the beam are required for applications such as the doping of indium phosphide used in heterostructures. In such applications, a finely focused beam of tin ions, preferably $Sn^+$ or $Sn^{++}$, deposits the ions in patterns of the host structure, to achieve particular electronic effects.

The preparation of a tin ion evaporation source has not heretofore been possible. Tin does not wet tungsten or other candidate evaporation element materials readily at temperatures near to the melting point of the tin. It is desirable to operate at such temperatures just above the melting point, to prolong the life of the source by avoiding burnout of the source element, and to prevent overly rapid evaporation of the tin in the ion column. Even if the operating temperature of the ion evaporation source is raised far above the desirable operating level, the source still does not run well to produce a uniform, fine beam of tin ions.

consequently, there is a need for an ion evaporation source for tin ions. The approach should permit stable, long-life operation of the source at temperatures not far above the melting point of tin. The present invention fulfills this need, and further provides related advantages.

SUMMARY OF THE INVENTION

The present invention provides an ion evaporation source for tin, which is operable at temperatures just above the melting point of tin. The source has long operating life of at least several hundred hours, and is stable in operation.

In accordance with the invention, a process for preparing an evaporation element for tin comprises the steps of furnishing an ion evaporation source; coating the evaporation source with gallium; and loading the evaporation source with tin.

The ion evaporation source may be of any appropriate type, but preferably is formed of a needle-shaped emitter supported in a heater element that also provides the reservoir for the tin. The emitting portion of the emitter and the portion of the heater element that acts as the reservoir are coated with a coating material, gallium, that is wetted by the tin, so that during operation of the evaporation source the molten tin can move from the reservoir to the emitter, and thence to the emitter tip where ion evaporation occurs. In the absence of such wetting, the evaporation source does not operate properly.

The source is operable with naturally occurring tin. However, it has been found that enriched tin, having a higher concentration of $Sn^{120}$ than occurs in nature, is a preferable source of the evaporated ions. This source of tin produces a relatively higher current density of $Sn+$ and $Sn++$ ions than obtained with naturally occurring tin as the source.

As will be discussed, the invention extends to a process for preparing an evaporation source, a process for providing a beam of tin ions, and an evaporation source.

Other features and advantages of the invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
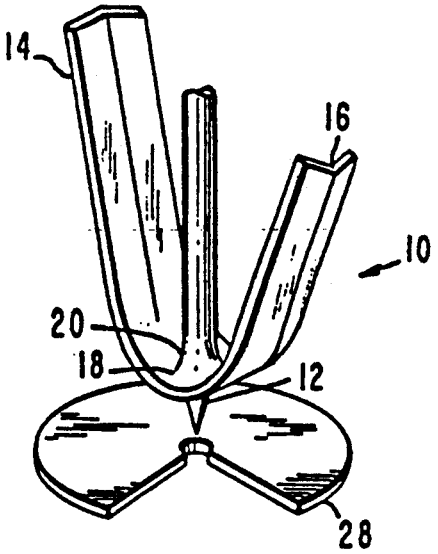
FIG. 1 is a perspective view of a liquid metal ion source.

The present invention relates to a liquid metal ion source, a preferred embodiment of which is indicated by the numeral 10 in FIG. 1. The ion source 10 includes an evaporation substrate needle 12 typically having a tip radius of less than about 20 micrometers and an apex half angle of less than about 49.5 degrees, which extends through a hole (not shown) at the lower end of a generally U-shaped heater element 14. A heater element 14 is in the form of a ribbon having a depressed center to form a channel 16 therein. Preferably, both the needle 12 and the heater element 14 are formed of tungsten, which is a refractory metal that is of sufficient formability that such components may be prepared by conventional metallurgical processes. Rhenium, molybdenum, and other refractory metals may also be used. A reservoir 18 of a liquid ion source alloy containing the ions to be emitted is contained within and upon the heater element 14, including the lowest point of the U-shaped heater element 14 where the needle 12 penetrates through the hole in the heater element 14. An electrical current produced by a voltage $V_H$ is passed through the heater element 14 to melt the ion source alloy in the reservoir 18, which then forms a liquid fillet 20 between the needle 12 and the heater element 14.

Figure 2:
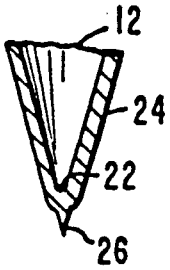
FIG. 2 is an enlarged cross-sectional view of a detail of FIG. 1, taken generally on line 2—2.

Referring to FIG. 2, the liquid ion source metal, tin, from the reservoir 18 flows toward a point 22 of the needle 12, forming a liquid layer 24 along the tip of the needle 12. At the very point 22 of the needle 12, where the liquid layers 24 from the sides of the needle 12 meet, the action of an applied external electrostatic field produced by an extraction electrode 28 draws the liquid layer 24 downwardly to form a cusp 26, which serves as the emitter point for the ion source 10. That is, the ions emitted by the ion source 10 are preferably emitted only from the cusp 26, so that ions appear to emanate from a point source of extremely small dimensions. Positively charged metallic ions are drawn from the cusp 26 by the extraction electrode 28 and exit the ion source 10 through a hole in the extraction eletrode 28. With this configuration, the current density of emitted ions at the cusp 26 can be very large, typically on the order of $10^6$ amperes per square centimeter per steradian.

As described in the preceding paragraph, the liquid layer 24 desirably flows from the reservoir 18 down the surface of the needle 12 to the cusp 26, for emission. However, in the absence of wetting of the liquid layer 24 to its substrate, it is difficult to initiate a flow of metal to form the reservoir 18, and it is similarly difficult to initiate a flow of metal along the needle 12 in the layer 24.

Figure 4:
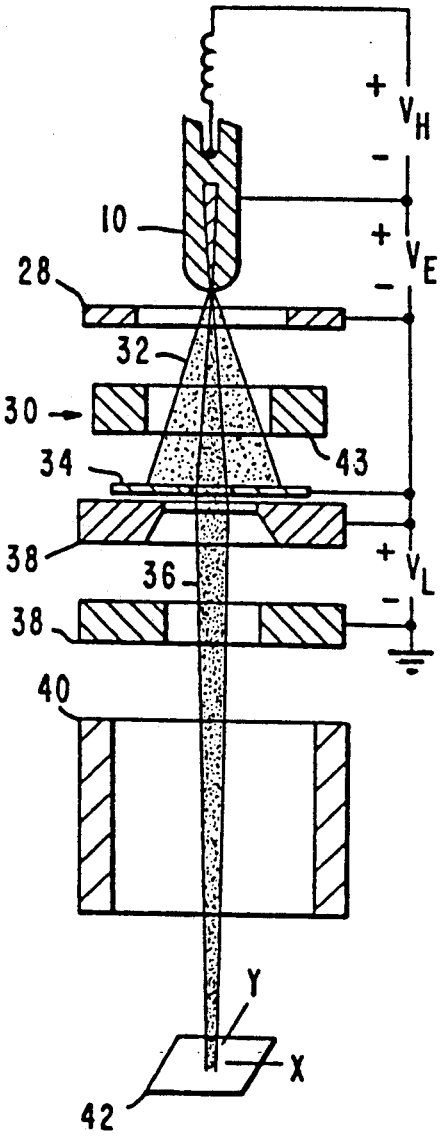
FIG. 4 is a schematic sectional side view of a scanning ion probe employing a liquid metal ion source.

FIG. 4 illustrates one important application of the liquid metal ion sources of the type illustrated in FIG. 1 and 2, and in which the present invention can be used. The ion source 10 is mounted in a scanning ion probe 30. The extraction electrode 28, which is negatively biased with respect to the needle 12 by a voltage $V_E$, draws ions out of the cusp 26, draws ions out of the cusp 26, to form an ion beam 32. The cross-sectional shape of the beam of ions 32 is defined by an aperture 34. The transmitted beam 36 emerging from the aperture 34 is passed through accelerating electrodes 38 which increase the energy of the beam 36, inasmuch as the second accelerating electrode is negatively biased with respect to the first by a voltage $V_L$. The beam 36 passes through electrostatic deflection electrodes 40, wherein the beam is deflected form side to side to move in a scanning fashion across the surface of a target 42. The transmitted beam 36 can be used to write various patterns upon the surface of the target 42 in the form of ion-implanted zones of controllable shape and type.

Optionally, there is provided an ion separator 43 to deflect certain ions by differing amounts, to permit only desired ions to reach the target 42. The separator 43 is preferably positioned between the extraction electrode 28 and the aperture 34, and includes means to produce a magnetic and an electrical field within the separator 43. The fields within the separator 43 deflect the moving ions by amounts which are related to the mass, velocity, and charge of the ions in the beam. By varying the strength of the magnetic and electrical fields and the positioning of the mass separator 43, it is possible to allow only a single desirable species to pass through the aperture 34 to be implanted in the target 42.

These elements of the probe 30 are within a vacuum chamber (not shown) that may be evacuated so that the ions of the beam can pass to the target unimpeded.

Figure 3:
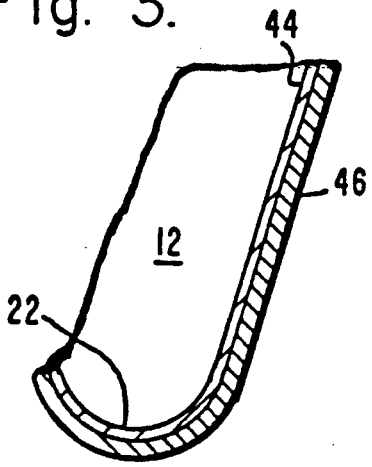
FIG. 3 is an enlarged cross-sectional view of a needle illustrating the coating thereupon and the tin source layer.

In accordance with the invention, and as shown in FIG. 3, a wettability-enhancing coating 44 gallium is deposited upon the ion source 10, and particularly upon the emitter needle 12 and the portion of the heater element 14 that forms the resorvoir 18. Such a coating is preferably applied by melting the element gallium in a suitable crucible at a temperature of about 300 C., and dipping the lower portion of the ion source 10, down to the level of the reservoir 18, into the liquid gallium for a few seconds. When the ion source 10 is withdrawn from the molten gallium, a coating of the gallium adheres to the portion of the ion source 10 that was immersed. Excess gallium can be removed by tapping or shaking the ion source 10 while the gallium is still molten, so that the excess gallium falls from the source 10. The success of the coating procedure can be judged by visual inspection, which may include magnifying the source 10 with a magnifier. If the gallium has not covered the portion of the needle 12 over which the tin source metal is to flow, and the reservoir 18, the immersion procedure can be easily repeated. Optionally, to further ensure proper wetting the gallium-coated needle may be operated as a gallium liquid metal ion source for a short period of time.

Other approaches to application of the coating 44 are also operable, such as evaporating the coating 44 onto the surface of the ion source 10. However, the immersion method is so easy to perform that it is preferred.

After the coating 44 has been applied, a quantity of tin is loaded into the reservoir 18. The amount of tin required is small, and typically about 25 milligrams of tin is placed into the reservoir 18. The tin can be naturally occurring tin of normal commercial purity, preferably 99.99 percent pure tin. In another approach, an isotopically enriched tin can be used to provide a higher current density of a particular tin ion to the target 42.

That is, in commercial operation of the source 10, it is normally the objective to supply in the beam reaching the target as high a current as possible of a single isotope of tin having a single ionization state. A high current of a single isotope can be best achieved by providing as high a concentration as possible of that isotope in the reservoir 18. In the present case, the isotope $Sn^{120}$ was selected as the isotope of most interest, and tin having an enhanced concentration of that isotope was used in most experiments. Isotopically enriched tin having a concentration of $Sn^{120}$ of about 99.6 percent was used. By comparison, $Sn^{120}$ comprises about 33 percent of naturally occurring tin. As will be seen from the examples, evaporation from this tin source yielded $Sn+$ and $Sn++$ ions, and the separator 43 is used to remove either of these ions from the beam so that the beam reaching the target is exclusively of the other type.

Thus, the invention extends to a process for preparing an evaporation source, a process for providing a beam of tin ions, and an evaporation source. A process for preparing an evaporation element for tin comprises the steps of furnishing an ion evaporation source; coating the evaporation source with gallium coating material; and loading the ion source with tin. A process for furnishing a beam of tin ions comprises the steps of furnishing an ion evaporation source; coating the evaporation source with gallium; loading the ion source with tin; operating the ion source to form a beam of tin ions; and separating contaminant ions from the beam of tin ions. An ion evaporation source comprises an ion evaporation source substrate having an emitter thereon; a coating layer of gallium overlying the substrate; and a layer of tin over the coating layer.

After the ion source 10 is coated with the coating 44 and tin is loaded into the reservoir 18, the ion source 10 is assembled into the scanning ion probe 30 or other instrument. A vacuum is drawn, and an electrical current is passed through the heater element 14 to melt the tin in the reservoir 18, so that it flows down the needle 12 to the point 22. Thereafter, the source 10 may be operated by applying the extraction voltage $V_E$ in the manner discussed previously.

The following Examples are presented to illustrate aspects of the invention, and should not be taken as limiting of the invention in any respect.

EXAMPLE 1

The ion source 10 was constructed with a tungsten needle 12 and tungsten heater element 14. The reservoir 18 and portion of the needle 12 below the reservoir 18 were coated with gallium by the immersion method previously described. About 25 micrograms of natrurally occurring tin of 99.99 percent purity was placed into the reservoir 18. The source 10 was then assembled into the ion probe 30. The probe was pumped to a vacuum of about $10^{-6}$ millimeters of mercury. A voltage $V_H$ of about 6 volts was applied across the heater element 14, which produced a current through the element 14 of about 5.5 amps. This current was sufficient to heat the area of the reservoir 18 and the needle 14 to a temperature of about 400 C., at which temperature the gallium and the tin were both melted. With a spacing between the point 22 of the needle 12 and the extraction electrode 28 of about 0.050 inch, an extraction voltage $V_E$ of about 6000 to about 6500 volts was required. The source 10 and probe 30 operated satisfactorily under these conditions.

EXAMPLE 2

Example 1 was repeated using the same identical conditions, except that the previously described isotopically enriched tin was loaded into the reservoir. The spectrum of energies in the beam was measured using a conventional Faraday cup apparatus, with the separator 43 not in operation. The source 10 and probe 30 produce a beam having a high intensity of both Sn+ and Sn++, and also a small intensity of gallium ions. The current of Sn+ ions was about 15 picoamperes, and the current of Sn++ was about 22 picoamperes. When the separator 43 is operated, either the singly or doubly ionized tin ions are selected for deposition upon the target, by electrostatically extracting the selected ions from the other ions of the beam. The tin source of this Example 2 has been operated for about 130 hours, on 20 different evaporation runs, without failure. The source is highly stable in operation.

The present invention provides a high brightness liquid metal evaporation source of tin ions having a well defined beam of selected isotope composition and ionization level. Although particular embodiments of the invention have been described in detail for purposes of illustration, various modifications may be made without departing from the spirit and scope of the invention. Accordingly, the invention is not to be limited except as by the appended claims.

What is claimed is:

1. A process for preparing an evaporation element for tin, comprising the steps of:

furnishing an ion evaporation source;

coating the evaporation source with gallium; and loading the evaporation source with tin which includes a fraction of $Sn^{120}$ greater than present in naturally occurring tin.

2. The process of claim 1, wherein the evaporation source includes an element made of a metal selected from the group consisting of tungsten, rhenium, and molybdenum.

3. A process for furnishing a beam of tin ions, comprising the steps of:

furnishing an ion evaporation source;

coating the ion source with gallium;

loading the ion source with tin which includes a fraction of $Sn^{120}$ greater than present in naturally occurring tin;

operating the ion source to form a beam of tin ions; and separating contaminant ions from the beam of tin ions.

4. The process of claim 3, wherein the evaporation source includes an element made of a metal selected from the group consisting of tungsten, rhenium, and molybdenum.

5. An ion evaporation source, comprising:

an ion evaporation source substrate having an emitter thereon;

a coating layer of gallium overlying the substrate; and a layer of tin which includes a fraction of $Sn^{120}$ greater than present in naturally occurring tin over the coating layer.

6. The source of claim 5, wherein the evaporation source includes an element made of a metal selected from the group consisting of tungsten, rhenium, and molybdenum.

* * * * *